US006940415B2

(12) United States Patent
Nagata et al.

(10) Patent No.: US 6,940,415 B2
(45) Date of Patent: Sep. 6, 2005

(54) REACH TYPE FORKLIFT TRUCK

(75) Inventors: Kazuhiro Nagata, Kyoto (JP); Koji Yokoyama, Kyoto (JP); Youich Hiraki, Kyoto (JP)

(73) Assignee: Nippon Yusoki Co., Ltd., Kyoto (JP)

( * ) Notice: Subject to any disclaimer, the term of this patent is extended or adjusted under 35 U.S.C. 154(b) by 140 days.

(21) Appl. No.: 10/260,306

(22) Filed: Oct. 1, 2002

(65) Prior Publication Data

US 2003/0152451 A1 Aug. 14, 2003

(30) Foreign Application Priority Data

Feb. 12, 2002 (JP) ..... P2002-034484
Jun. 14, 2002 (JP) ..... P2002-175045

(51) Int. Cl.[7] ..... G08B 21/00

(52) U.S. Cl. ..... 340/657; 340/679; 340/686.1; 340/686.3; 340/680; 414/589

(58) Field of Search ..... 340/657, 679, 340/680, 686.1, 686.3, 685, 689.1, 440, 465, 691.1; 414/589, 631, 641, 635, 673; 180/140, 170, 209, 211, 171, 174

(56) References Cited

U.S. PATENT DOCUMENTS 4,011,478 A 3/1977 Reenstra
5,325,935 A * 7/1994 Hirooka et al. ..... 180/211
5,652,486 A * 7/1997 Mueller et al. ..... 318/369
6,385,518 B1 * 5/2002 Rickers et al. ..... 701/50

FOREIGN PATENT DOCUMENTS

| | | |
|---|---|---|
| EP | 1 150 124 A2 | 10/2001 |
| JP | 05-254788 | 10/1993 |
| JP | 6-81833 A | 3/1994 |
| JP | 2000-121379 A | 4/2000 |
| JP | 2001-302193 A | 10/2001 |
| JP | 2001-302198 | 10/2001 |
| JP | 2001-302198 A | 10/2001 |
| JP | 2002-019590 | 1/2002 |

* cited by examiner

*Primary Examiner*—Hung Nguyen
(74) *Attorney, Agent, or Firm*—Sughrue Mion, PLLC

(57) ABSTRACT

A reach type forklift truck includes a rotation sensor interposed between a load wheel and a load wheel shaft on which the load wheel is provided. A signal line for transmitting a detected signal of the rotation sensor is inserted in a guide groove formed in the load wheel shaft that extends along an axial direction thereof. The signal line is led out from a reach rail side of the load wheel.

10 Claims, 15 Drawing Sheets

REACH TYPE FORKLIFT TRUCK

BACKGROUND OF THE INVENTION

1. Field of the Invention

The present invention relates to a reach type forklift truck provided with a fork for lifting a load, the fork is movable back and forth.

2. Description of the Related Art

Conventionally, as a forklift truck for delivering a load, there is known such a reach type forklift truck as shown in FIG. 3. A reach type forklift truck, which is designated by reference numeral 1 in FIG. 3, includes a truck main body 2, a pair of straddle arms 3 respectively provided integrally with and extended forwardly from the truck main body 2, a mast 4 mounted between the pair of straddle arms 3 so as to be movable back and forth, and a fork 5 mounted on the mast 4 movably so as to be raised and lowered. On the bottom portion of the truck main body 2, there is disposed a drive wheel 6 that drives the truck. In the front end portions of the straddle arms 3, there are disposed a pair of load wheels 7 for supporting the weight of the load.

On the two straddle arms 3, more specifically, on the mutually opposed sides thereof, there are disposed a pair of reach rails 3*a*, as shown in FIG. 4. Each of reach rails 3*a* is formed in a substantially U-like shape, and the reach rails 3*a* are mounted in such a manner that their respective openings face the inside of the truck main body 2. A guide roller 8 mounted on the mast 4 is rollably fitted into the reach rails 3*a* through their openings.

By the way, in the thus structured conventional reach type forklift truck 1, slippage is detected, by detecting the difference between the drive wheel's rotation speed and the load wheel's rotation speed, for example.

In order to detect the rotation of the load wheels 7, as shown in FIGS. 4 and 5, a detect disk 9 including a large number of slits S formed in the outer peripheral edge portion thereof is coaxially mounted on the inside of the load wheel 7. Also a pickup sensor 10 is disposed on the lower portion of the reach rail 3 so as to be opposed to the slits S of the detect disk 9 to detect the slits S. The rotation speed of the load wheel 7 can be detected by detecting the slits S using the pickup sensor 10.

The pickup sensor 10 is mounted on a bracket 11 that is hang down from the lower portion of the reach rail 3*a*.

In the above-mentioned conventional reach type forklift truck 1, there are still left the following problems to be improved. That is, to detect the rotation of the load wheels 7, it is necessary not only to mount the detect disk 9 including a large number of slits S on the load wheels 7 but also to mount the pickup sensor 10 for detecting the slits S on the lower portion of the reach rail 3*a* via the bracket 11. Since many parts are required and machining of the detect disk 9 is troublesome, manufacturing costs of the forklift truck 1 is increased.

Also, in the conventional reach type forklift truck, since the gap between the lower surface of the reach rail 3*a* and the traveling road surface of the forklift truck 1 is narrow, there is an inconvenience that the bracket 11 collides with the uneven road surface or fallen objects such as stones. In order to avoid such inconvenience, the shape of the bracket 11 to be mounted on the reach rail 3*a* must be reduced in size, so that the shape and size of the pickup sensor 10 is limited.

In JP-A-2001-302198, there has been proposed an apparatus for detecting the number of rotations of a driven wheel of a reach type forklift truck. In a rotation detector disclosed as an embodiment in the publication, a sensor for detecting the number of rotations of the tire is mounted on a lower surface of a reach rail, and the sensor is protected by a guard (refer to FIGS. 1 and 2 in the publication). In addition, in a rotation detector disclosed as another embodiment in the publication, such a sensor is mounted on an axle and a detected portion is disposed on an inner circumference of the wheel at a position confronting the detected portion (refer to FIG. 9 in the same publication).

On the other hand, in detecting the number of rotations of a rotating body, there has been tried a method for detecting the number of rotations of a bearing which supports the rotating body rather than detecting directly the number of rotations of the objective rotating body, and there has been proposed a bearing on which a rotation detector is provided (JP-A-6-81833).

One example of the rotation detector disclosed in JP-2001-302193, the sensor is situated on the under surface of the reach rail and the sensor so situated is then protected by the guard, the sensor is protected by the guard from a direct collision with fallen objects. However, it is desirable for the sensor to be mounted and maintained in a condition in which neither collision nor other impacts can be applied to the sensor in order to maintain the required accuracy, and even if the sensor is protected by the guard, when considering the possibility that an impact applied to the guard is transmitted to the sensor via the reach rail, the accuracy of the sensor is not necessarily secured at a sufficient level. In addition, since mounting the guard is troublesome, the costs are increased.

In contrast, another example of the rotation detector disclosed in JP-A-2001-302193, the sensor is mounted on the axle and it is possible to eliminate a part such as the guard which protrudes outwardly and therefore from the viewpoint of maintaining the accuracy of the sensor, there seems to be no problem. On the contrary, as is described in the publication, this construction can become effective only in a case where a brake system is not mounted on the wheel.

In addition, in the bearing according to JP-6-81833 on which the rotation detector is provided, since the rotation of the inner race is detected by the sensor provided on the outer race, the rotating body needs to be fitted in the inner race. Namely, the rotating body which is an objective for detection is limited to an axle which is fitted in the inner race of the bearing or a rotating body which is adapted to rotate together with the axle. Due to this, this construction cannot be used for a driven wheel of a reach type forklift truck which is provided on the outer race of the bearing whose inner race is fixed to the axle.

SUMMARY OF THE INVENTION

The present invention aims at eliminating the above drawbacks found in the conventional reach type forklift truck. Accordingly, it is an object of the invention to provide a reach type forklift truck that can simplify a structure for detecting the rotation of load wheels thereby the manufacturing cost of the reach type forklift truck is decreased. Also, it is another object of the invention to provide a reach type forklift having a rotation sensor that can maintain a required accuracy and suppress an increase in manufacturing costs.

In attaining the above object, according to a first aspect of the present invention, there is provided a reach type forklift truck, including: a truck main body; a pair of straddle arms provided on and extended forwardly from the truck main body; a mast movably mounted on the straddle arms so as to move back and forth, the mast having rollers; a load wheel shaft fixed to the front portion of the straddle arm, the load wheel shaft having a guide groove; a load wheel rotatably disposed on the load wheel shaft; a rotation sensor for detecting the rotation of the load wheel; a signal line for transmitting a detected signal of the rotation sensor to the truck main body side; and a pair of reach rails in which the rollers are rollably fitted, the reach rails being provided on the mutually opposed sides of the straddle arms, wherein the rotation sensor is disposed at between the load wheel and the load wheel shaft, the guide groove extends from the neighboring portion of the rotation sensor to the reach rail side, the signal line is inserted in the guide groove.

According to a second aspect of the invention, in a reach type forklift truck as set forth in the first aspect of the invention, a brake device is so disposed as to surround the base end portion of the load wheel shaft, and the rotation sensor is disposed outwardly from the brake device.

According to a third aspect of the invention, in a reach type forklift truck as set forth in the first or second aspect of the invention, there is disposed a bearing at between the load wheel and the load wheel shaft so as to support the load wheel rotatably with respect to the load wheel shaft, wherein the rotation sensor is disposed on the bearing and detects a relative rotation of inner and outer races of the bearing.

According to a fourth aspect of the invention, in a reach type forklift truck as set forth in the third aspect of the invention, the inner race is fixed on the load wheel shaft, the outer race is fixed on the load wheel thereby the outer race is rotatable with respect to the inner race, the rotation sensor includes a detected element disposed on the outer race and is rotatable with the load wheel, and an detecting element disposed on the inner race and is detactable the rotation of the detected element.

According to a fifth aspect of the invention, in a reach type forklift truck as set forth in the first or second aspect of the invention, the rotation sensor is a rotary encoder, the body of the rotary encoder is mounted on the center of the load wheel shaft, and the rotary shaft of the rotary encoder is connected to the load wheel in such a manner that it can be rotated integrally with the load wheel.

According to a sixth aspect of the invention, there is provided a reach type forklift truck, including: a truck main body; a straddle arm provided on and extended forwardly from the truck main body; a wheel shaft fixed to the straddle arm; a bearing having an inner race engaged on the wheel shaft and an outer race rotatable with respect to the inner race; a wheel rotatably disposed on the wheel shaft via the bearing; and a rotation sensor for detecting a rotation of the wheel, wherein the rotation sensor has a detected element disposed on the outer race and rotates together with the wheel, and a detecting element disposed on the inner race and is detectable a rotation of the detected element.

Here, "detecting a rotation of the wheel" means detecting the number of rotations of the wheel, or detecting the rotating speed of the wheel. Also, the conversion of the number of rotations of the wheel into the rotating speed thereof is included in the meaning.

According to a seventh aspect of the invention, in a reach type forklift truck as set forth in the sixth aspect of the invention, the detected element is a magnet which is magnetized, and the detecting element is a magnetic sensor for detecting a variation in a magnetic field caused by the rotation of the magnet.

According to a eighth aspect of the invention, in a reach type forklift truck as set forth in the sixth or seventh aspect of the invention, the wheel is rotatably disposed on the load wheel via a plurality of bearings, and the rotation sensor is provided outwardly from a bearing that is disposed at a position closest to a base end portion of the wheel shaft.

According to a ninth aspect of the invention, in a reach type forklift truck as set forth in the sixth or seventh aspect of the invention, the wheel is constituted by a hub formed into a cylindrical shape and a tire provided on an outer circumference of the hub, and the hub has a bearing installing portion for fittingly installing the outer race, and a containing portion directed toward the base end portion of the wheel shaft in a recessed fashion.

According to a tenth aspect of the invention, in a reach type forklift truck as set forth in the sixth or seventh aspect of the invention, further includes a brake device for braking the wheel, the brake device being disposed in the containing portion.

DETAILED DESCRIPTION OF THE PREFERRED EMBODIMENTS

Figure 3:
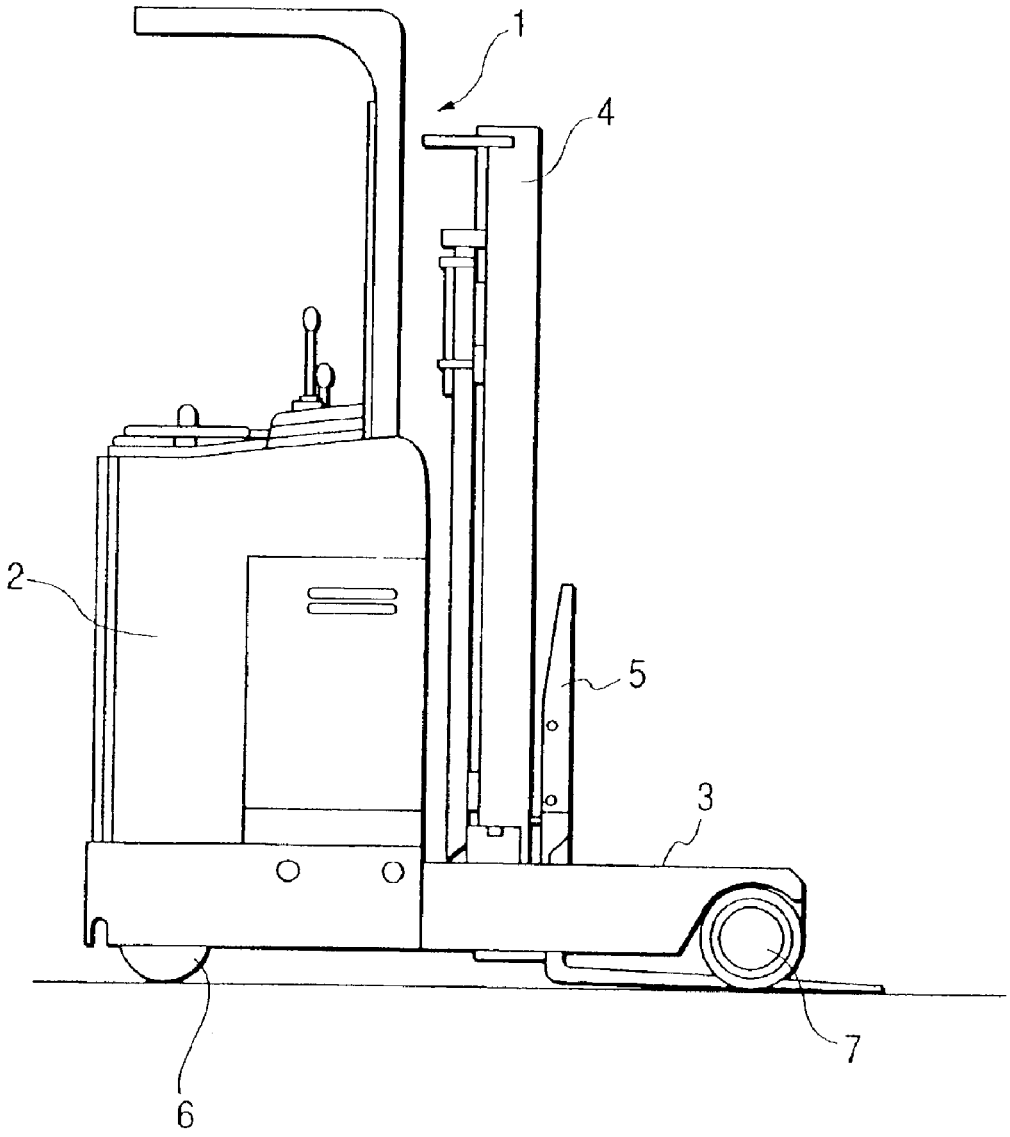
FIG. 3 PRIOR ART
FIG. 3 is a side view of a general reach type forklift truck.
Figure 4:
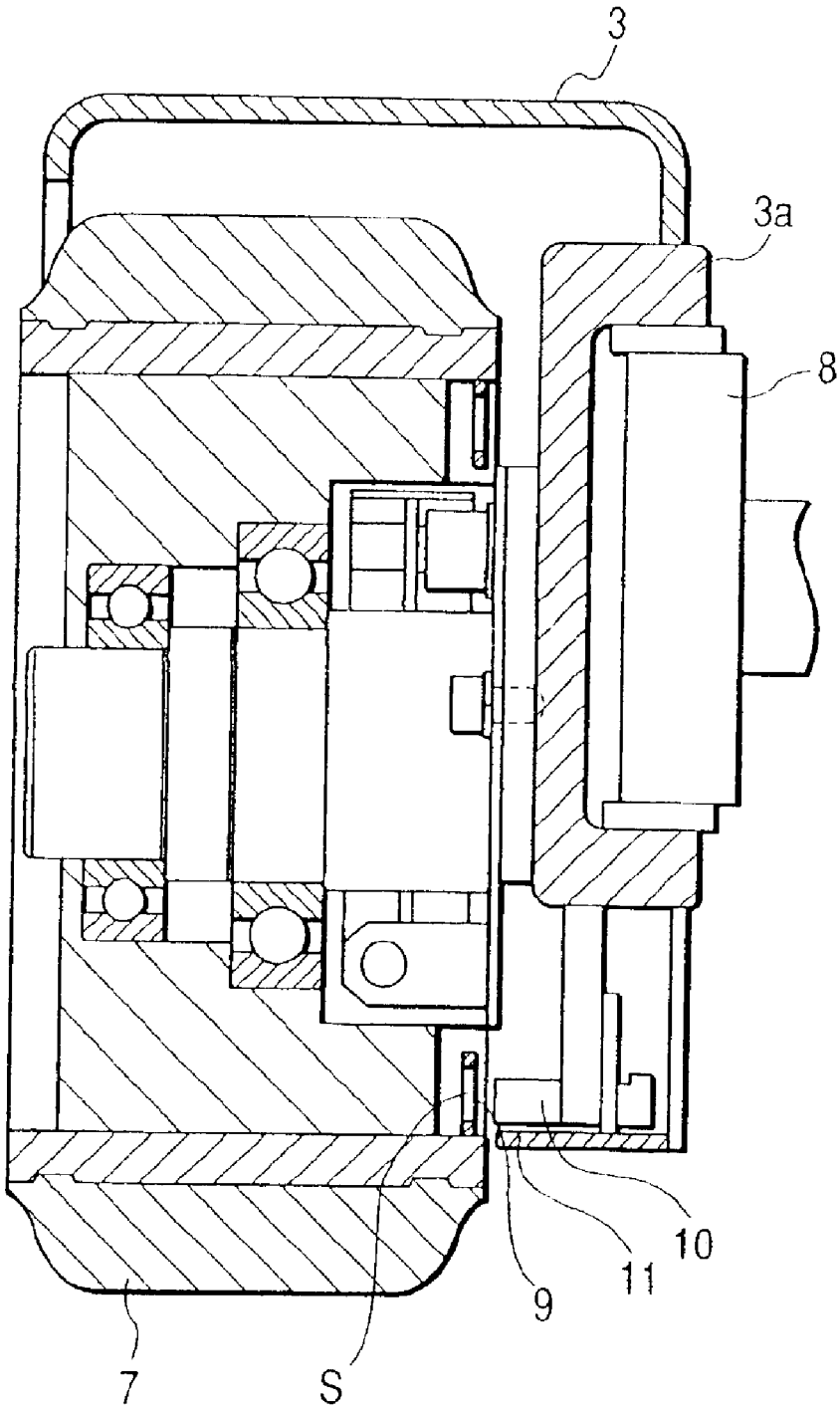
FIG. 4 PRIOR ART
FIG. 4 is a sectional view of main portions of a conventional reach type forklift truck.
Figure 5:
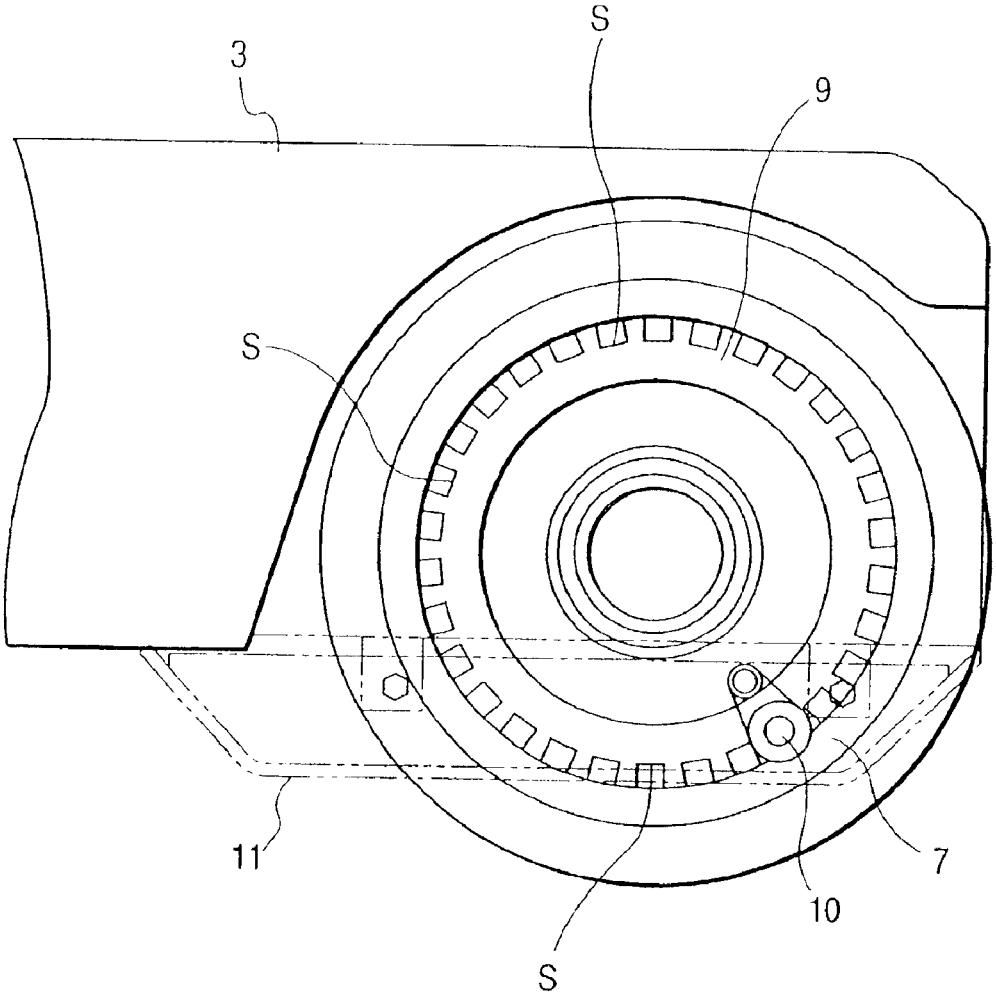
FIG. 5 PRIOR ART
FIG. 5 is a side view of main portions of the conventional reach type forklift truck.

Now, description will be given below of a first embodiment of a reach type forklift truck according to the invention with reference to FIG. 1. By the way, in the following description, the main composing parts of the present reach type forklift truck are common to the structure shown in FIG. 3 and, therefore, they will be described using the same reference numerals as in FIG. 3.

The reach type forklift truck 1 according to the present embodiment includes a truck main body 2, a pair of straddle arms 3 mounted on the truck main body 2, a mast 4 so mounted on the truck main body 2 as to be movable back and forth, and a pair of load wheels 7 respectively mounted on their associated straddle arms 3. Also, on the mutually opposed sides of the two straddle arms 3, there are mounted a pair of reach rails 3*a* with which the guide rollers 8 of the mast 4 can be rollably engaged.

On the forward side portions of the straddle arms 3, there is disposed a load wheel shaft 20 on which the load wheels 7 can be rotatably mounted. Also, between the load wheel shaft 20 and load wheel 7, there is interposed a rotation sensor 21 for detecting the rotation of the load wheel 7. A signal line 22, which is used to transmit the detected signal of the rotation sensor 21, is disposed within a guide groove 23 formed in the load wheel shaft 20 and extended along the longitudinal direction of the load wheel shaft 20. The signal line 22 is drawn out from the end portion of the load wheel 7 on the reach rail 3*a* side thereof.

The load wheel shaft 20 includes a flange 20*a* formed integrally with the base portion thereof. The load wheel shaft 20 is fixed integrally to the reach rail 3*a* through the flange 20*a* by welding.

Between the base end portion of the load wheel shaft 20 and the inner peripheral surface of the load wheel 7, there is interposed a brake device 26 which is used to brake the load wheel 7.

The brake device 26 is a drum brake which uses the inner peripheral surface of the load wheel 7 as a brake drum. In more detail, the brake device 26 includes a pair of an arc-shaped leading shoes 27 (in FIG. 1, only one of them is shown) which can be contacted with the inner peripheral surface of the load wheel 7, an anchor pin 28 for supporting one-end portions of the two leading shoes 27 rotatably, and a wheel cylinder 29 which is interposed between the other-end portions of the two leading shoes 27 and urges the other-end portions of the two leading shoes 27 to separate them from each other to press these leading shoes 27 against the inner peripheral surface of the load wheel 7 so as to brake the load wheel 7. The respective parts of the brake device 26 are assembled through the anchor pin 28 to a base plate 24. This base plate 24 is fixed to the flange 20*a* of the load wheel shaft 20 by a plurality of bolts 25, thereby the brake device 26 is mounted on the load wheel shaft 20.

Also, on a portion of the load wheel shaft 20 that is situated outwardly from the brake device 26, outwardly along the axial direction of the load wheel shaft 20, there are disposed a pair of bearings 30 and 31 which are used to mount the load wheels 7 on the load wheel shaft 20 rotatably. In the present embodiment, the rotation sensor 21 is mounted on the inner side bearing 31.

Figure 6:
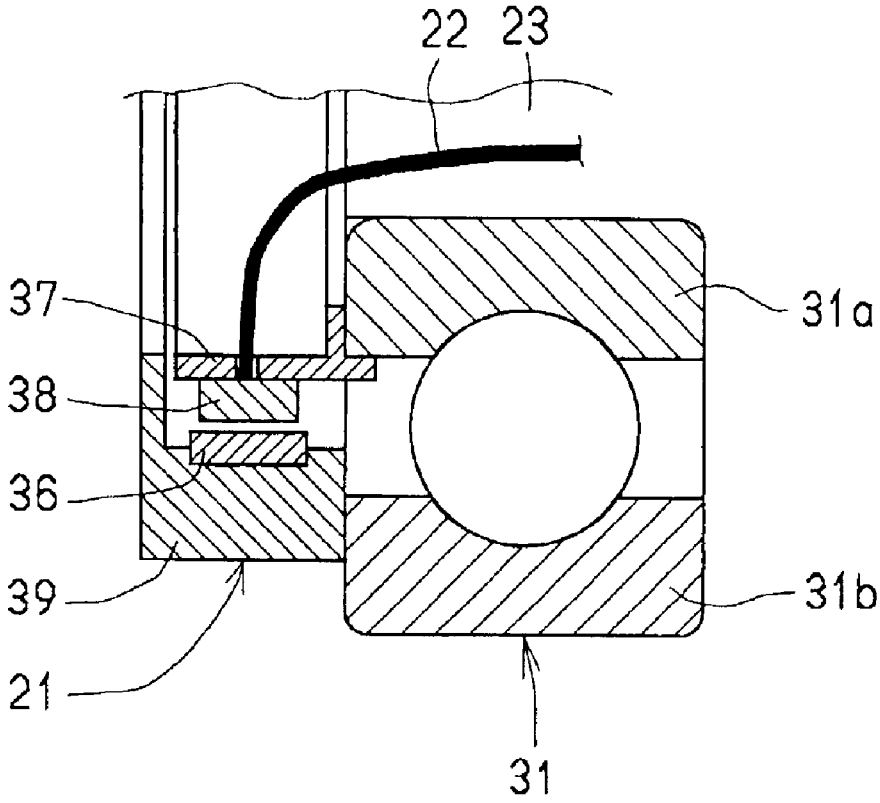
FIG. 6 is an enlarged sectional view of main portions of a rotation sensor used in the first embodiment of the invention.

As shown in FIG. 6, the rotation sensor 21 includes a detecting element 38 mounted on an inner race 31*a* of the bearing 31 to be fixed to the load wheel shaft 20 and a large number of magnetic poles 36 disposed at intervals in the peripheral direction of an outer race 31*b* of the bearing 31. By detecting magnetic forces generated from magnetic poles 36 through the detecting element 38, the relative rotation between the inner and outer races 31*a* and 31*b*, that is, the number of rotations and the rotation speed of the load wheel 7 can be detected.

Figure 7:
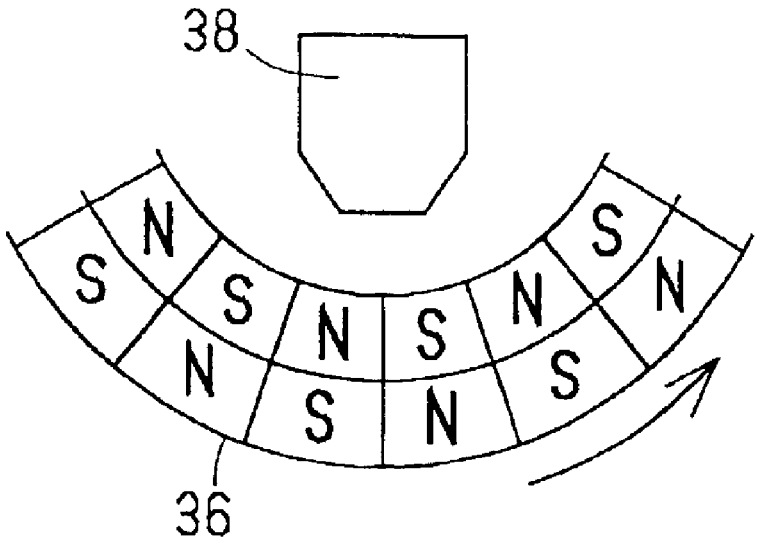
FIG. 7 is an explanatory view of the operation of the rotation sensor used in the first embodiment of the invention.

In more detail, there is fixed a ring-shaped magnetic pole 36 on the outer race 31*b* via a support member 39; and there is mounted a magnetic detect element 38 on the inner race 31*a* via a support member 37 in such a manner that the magnetic detect element 38 is opposed to the magnetic pole 36. As shown in FIG. 7, the magnetic pole 36 is magnetized alternately on the N and S poles. As the magnetic pole 36 is rotated in the arrow mark direction together with the rotation of the outer race 31*b*, the above-mentioned N and S poles are detected by the magnetic detect element 38 and the detected signal is converted to a pulse signal, so that the number of rotations of the load wheel 7 can be detected.

The guide groove 23 is formed in the under portion of the load wheel shaft 20 and, because the end portion of the guide groove 23 is formed open toward the lower portion of the reach rail 3*a*, the signal line 22 to be inserted into the guide groove 23 is drawn out to the under side portion of the reach rail 3*a*.

In the thus structured reach type forklift truck 1, the rotation sensor 21 is disposed on the bearing 31 and detects the relative rotation of the inner and outer races 31*a*, 31*b*. The installation position of the rotation sensor 21 can be set within a mounting hole formed in the load wheel 7 for mounting the bearing 31. This mounting hole is previously formed in the load wheel 7 and, therefore, the rotation sensor 21 can be installed without greatly changing the structure.

Also, the signal line 22 is guided to the under side portion of the reach rail 3*a* through the interior of the guide groove 23 formed in the load wheel shaft 20, so that the signal line 22 can be then connected to control equipment (for example, control equipment disposed on the truck main body 2) along the under surface of the straddle arm 3. As a result, the projecting amount of a member to be projected from the under surface of the reach rail 3*a* is restricted greatly and, therefore, even in case where a clearance between the reach rail 3*a* and travelling road surface is narrow, the installation of the rotation sensor 21 is possible.

Also, since the rotation sensor 21 is disposed outwardly from the brake device 26, the rotation sensor 21 can be situated at a position distant from the brake device 26. This can prevent the rotation sensor 21 from being influenced by the heat that is generated in the brake device 26.

Figure 1:
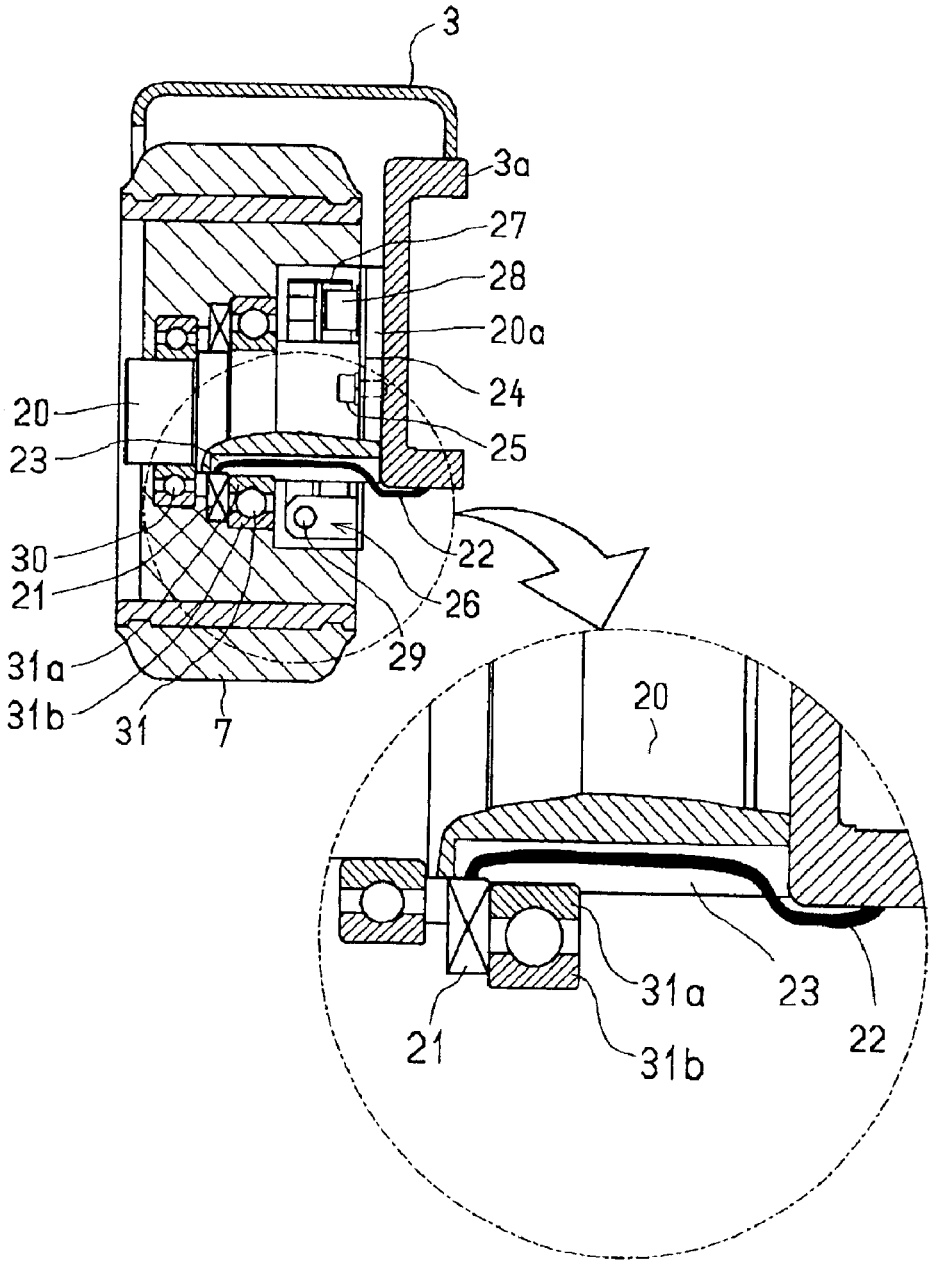
FIG. 1 is a sectional view of main portions of a reach type forklift truck according to a first embodiment of the invention.

Although the guide groove 23 shown in FIG. 1 is formed in the under part of the load wheel shaft 20, the guide groove may formed in a side part or in an upper part of the load wheel shaft 20. In each case, it is preferable to mount the rotation sensor 21 in the vicinity of the guide groove 23. That is, in case where the guide groove 23 is formed in the under part of the load wheel shaft 20, the rotation sensor 21 is preferably disposed at the under part of the load wheel shaft 20. In case where the guide groove 23 is formed in the side part of the load wheel shaft 20, the rotation sensor 21 is preferably disposed at the side part of the load wheel shaft 20. In case where the guide groove 23 is formed in the upper part of the load wheel shaft 20, the rotation sensor 21 is preferably disposed at the upper part of the load wheel shaft 20. By this structure, the signal line 22 is led into the guide groove 23 in the vicinity of the rotation sensor 21, so that the signal line 22 does not interfere with other parts. Therefore, the signal line 22 is smoothly led to the reach rail 3*a* side without being damaged.

FIG. 1 shows an example of he guide groove 23 that is extended from the neighboring portion of the rotation sensor 21 to the under side of the reach rail 3*a*. By leading the signal line 22 to the under side of the reach rail 3*a*, the signal line 22 can be arranged along the under surface of the reach rail 3*a*. Therefore, the signal line 22 is prevented from interfering with other parts and being damaged. Also, forming a hole in the reach rail 3*a*, in which the guide roller 8 rolls, in order to insert the signal line 22 is unnecessary; a troublesome machining is not required.

The present invention is not limited to the above-described embodiment. For example, the guide groove formed in the load wheel shaft 20 may extend from the neighboring portion of the rotation sensor 21 to the upper part or to the side part of the reach rail 3*a*.

In the above-described embodiment, the rotation sensor to be attached on the bearing 31 includes the detecting element 38 fixed to the inner race 31*a* of the bearing 31, and the magnetic pole 36 fixed to the outer race 31*b* of the bearing 31. As the detecting element 38, a hall element, a magnetoresistive element, and an optical fiber magnetic sensor are exemplified. If there is a enough space between the load wheel 7 and the load wheel shaft 20, as a rotation sensor, a sensor that uses optics may be used instead of the rotation sensor 21 that uses magnet.

Figure 2:
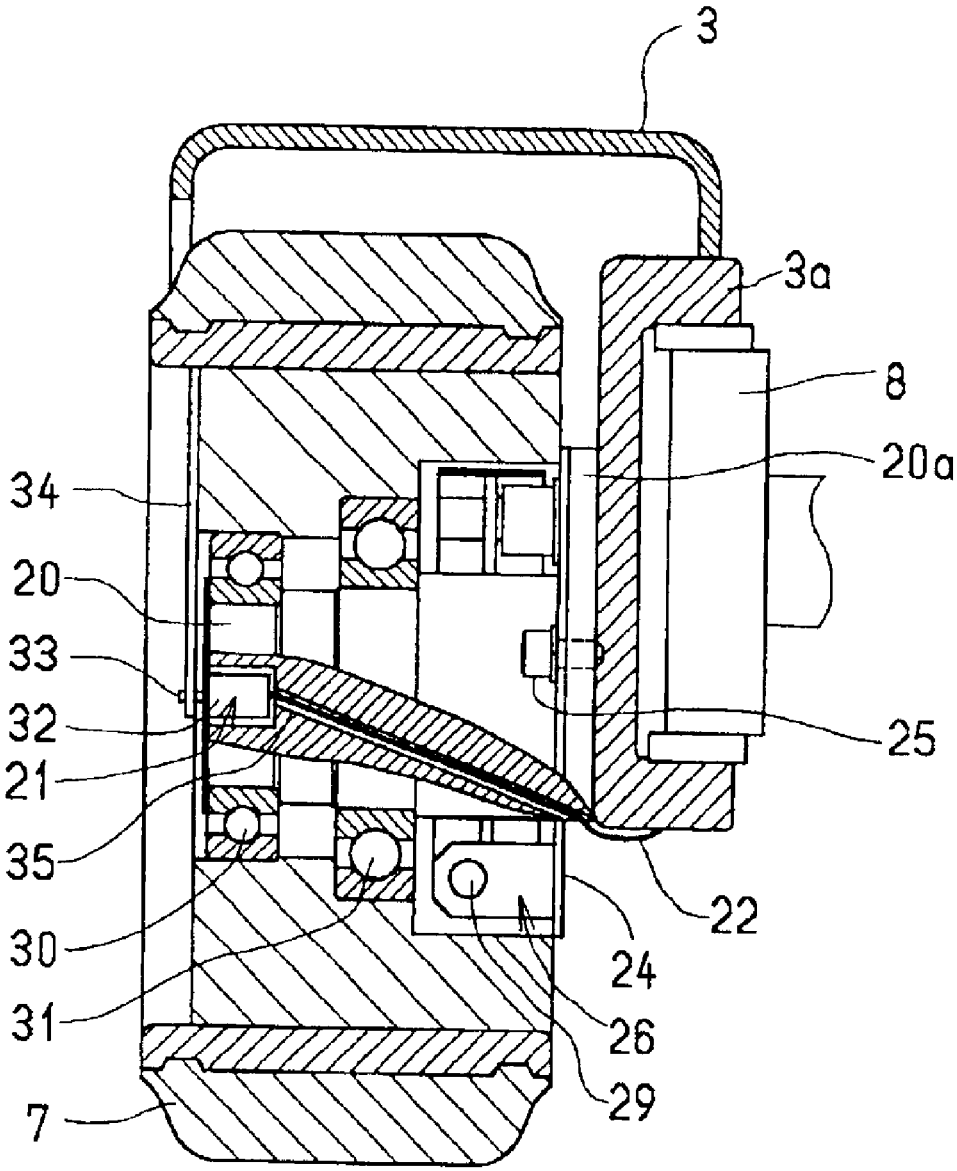
FIG. 2 is a sectional view of main portions of a reach type forklift truck according to a second embodiment of the invention.

The rotation sensor 21 may be disposed not on the bearing 31 but also on another place. FIG. 2 shows a second embodiment in which a body 32 of the rotary encoder is mounted on the top end portion of the center of the load wheel shaft 20 and a rotary shaft 33 of the rotary encoder is connected to the load wheel 7 via a stopper 34 thereby the rotary shaft 33 rotates integrally with the load wheel 7. In this structure, a guide groove 35, in which the signal line 22 connected to the rotation sensor 21 is inserted, is inclined from the center of the shaft to the outer peripheral of the shaft. Since the guide groove 35 is formed inside of the load wheel shaft 20, all around the signal line 22 is guarded by the load wheel shaft 20 thereby the signal line 22 is prevented from being damaged or being cut.

Figure 8:
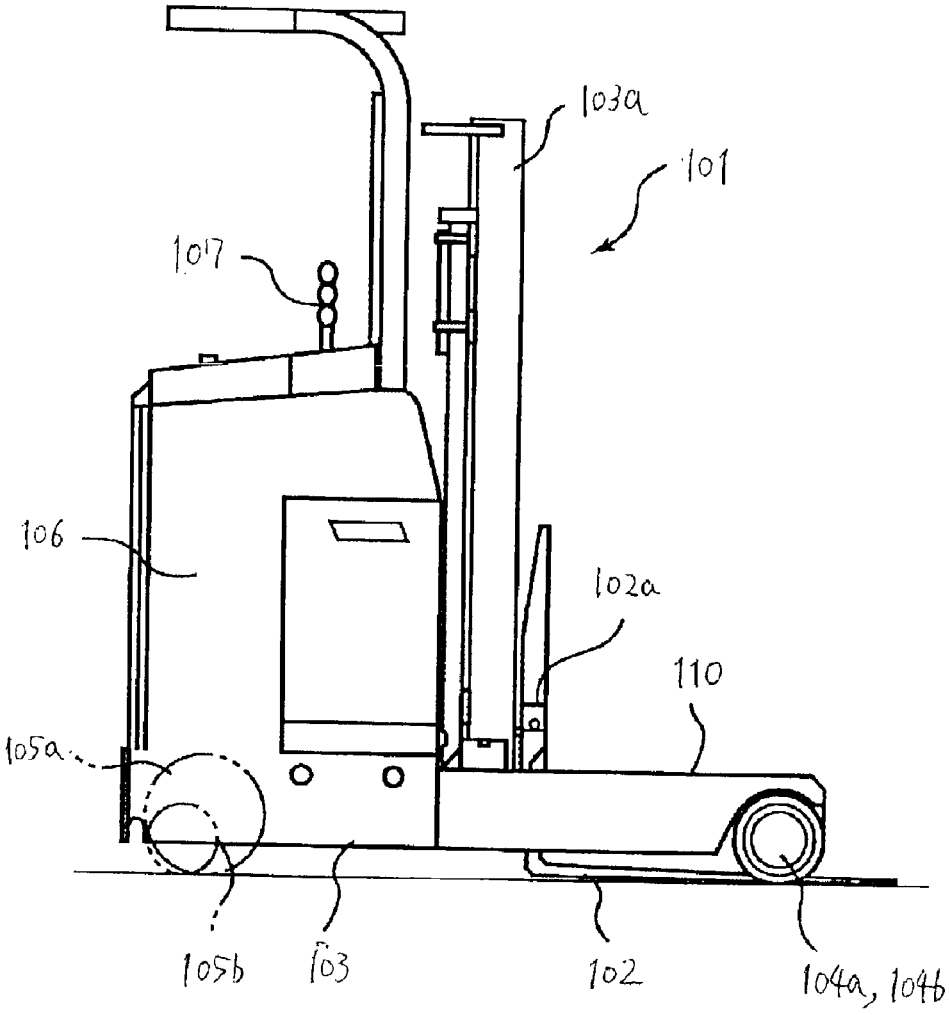
FIG. 8 is a side view of a reach type forklift truck according to a third embodiment of the invention.

Referring to FIG. 8 showing a side view of a reach type forklift truck 101 according to a third embodiment of the invention, the forklift truck includes a pair of left and right straddle arms 110 provided on and extended forwardly from a truck main body 103, and two left and right front wheels (load wheels) 104*a*, 104*b* provided at front portions of the respective straddle arms 110. In addition, there are provided a mast 103*a* which erects from the straddle arms 110 and which is adapted to move back and forth along the straddle arms 110. A lift bracket 102*a* on which a fork 102 is disposed is mounted on the mast 103*a* in such a manner as to move vertically along the mast 103*a*. Furthermore, two left and right rear wheels 105*a*, 105*b* are provided at a rear part of the truck main body 103, and the left rear wheel 105*a* is a drive wheel and a brake can be applied thereto, while the right rear wheel 105*b* is a caster.

In addition, an apparatus containing box 106 is also provided on the truck main body 103 for containing a driving source for driving the left rear wheel 105*a* and operating the mast 103*a*and other necessary apparatuses. A driver is seated on a driver's seat provided on the truck main body 103 and operates the reach type forklift truck 101 by manipulating levers 107 which perform predetermined functions. The levers 107 are projected upwardly from the apparatus containing box 106.

Figure 9:
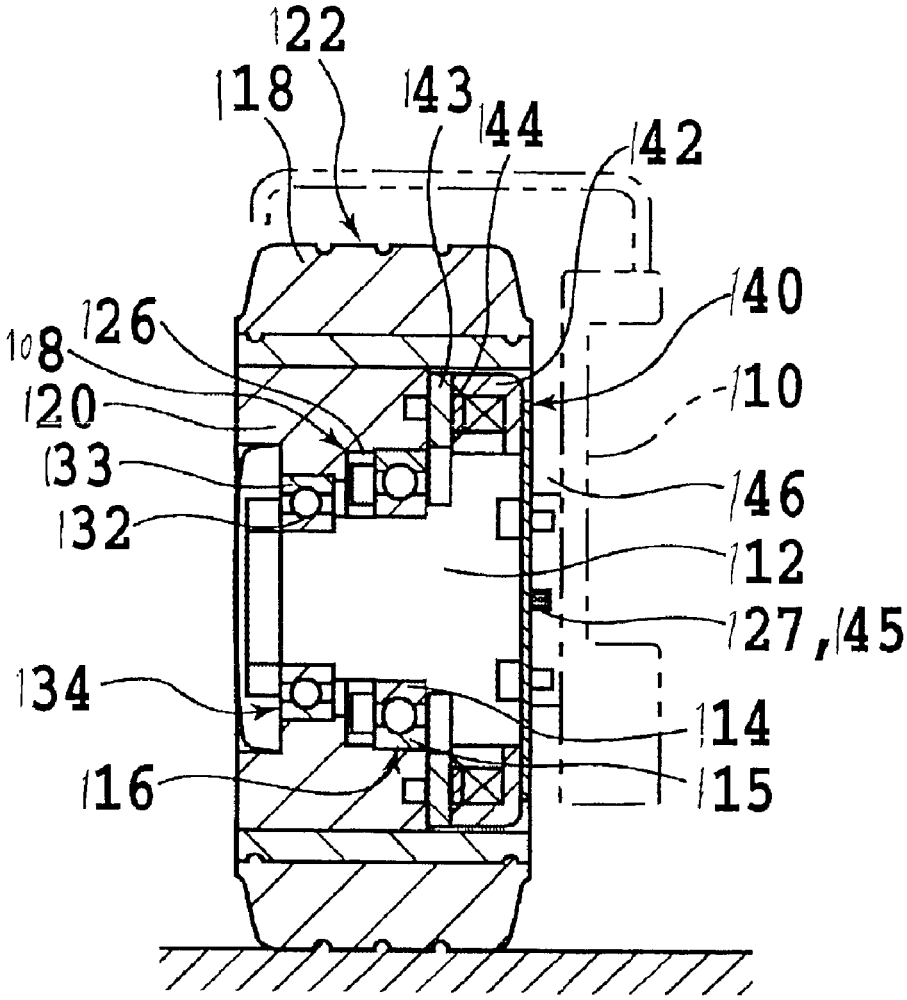
FIG. 9 is a cross-sectional view showing a load wheel and a rotation sensor according of the third embodiment.
Figure 10:
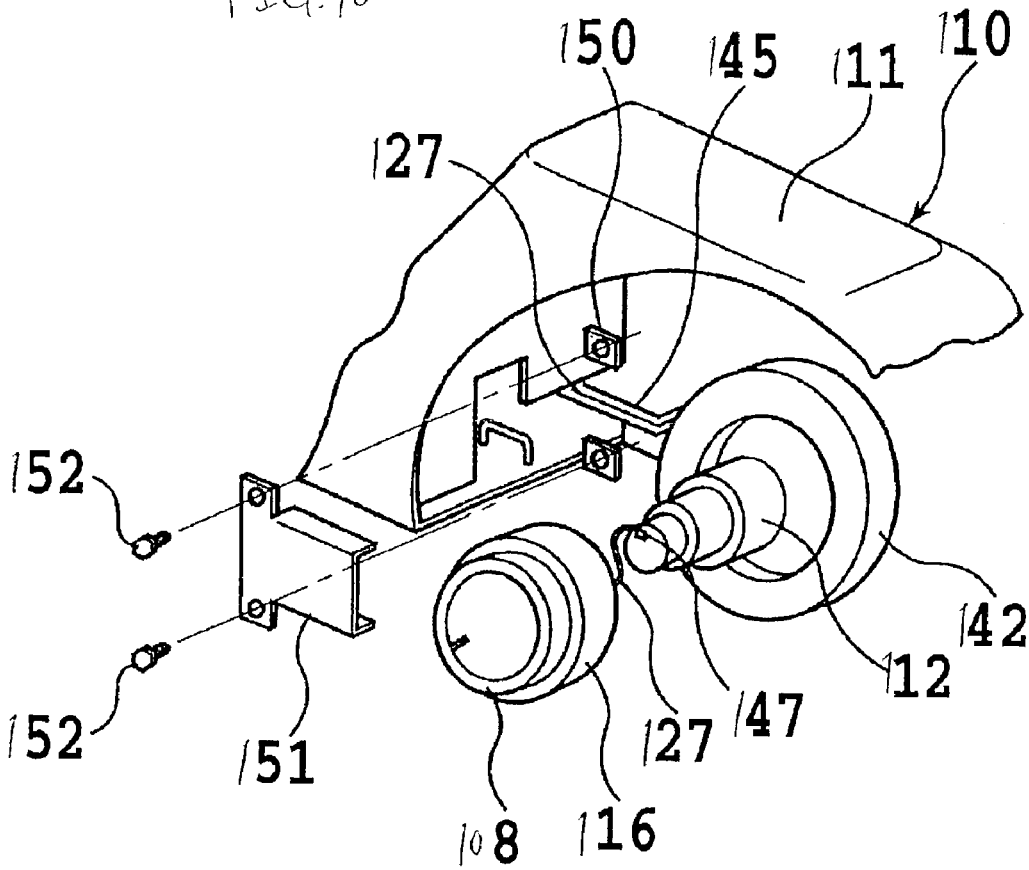
FIG. 10 is a perspective view showing a portion in the vicinity of a wheel housing of the third embodiment, with part of component parts being exploded.

Referring to FIGS. 9 and 10 which show, respectively, sectional and perspective views, a wheel housing 111 which opens outwardly and downwardly is formed in a front end portion of the straddle arm 110, and a load wheel shaft 112 is fixedly coupled to and supported in a cantilever-like fashion on the straddle arm 110 in the interior of the wheel housing 111 in such a manner as to direct outwardly. A load wheel 122 is mounted rotatably on this load wheel shaft 112 via a first bearing 134 and a second bearing 116. The load wheel 122 corresponds to the right front wheel 104*a* or the left front wheel 104*b* which are shown in FIG. 8. Since the load wheel 122 can be the right front wheel 104*a* or the left front wheel 4*b* depending upon the mounting orientation, the front wheels are described in such a way with the different reference numerals. The load wheel 122 so described corresponds to the load wheel according to the invention.

Figure 11:
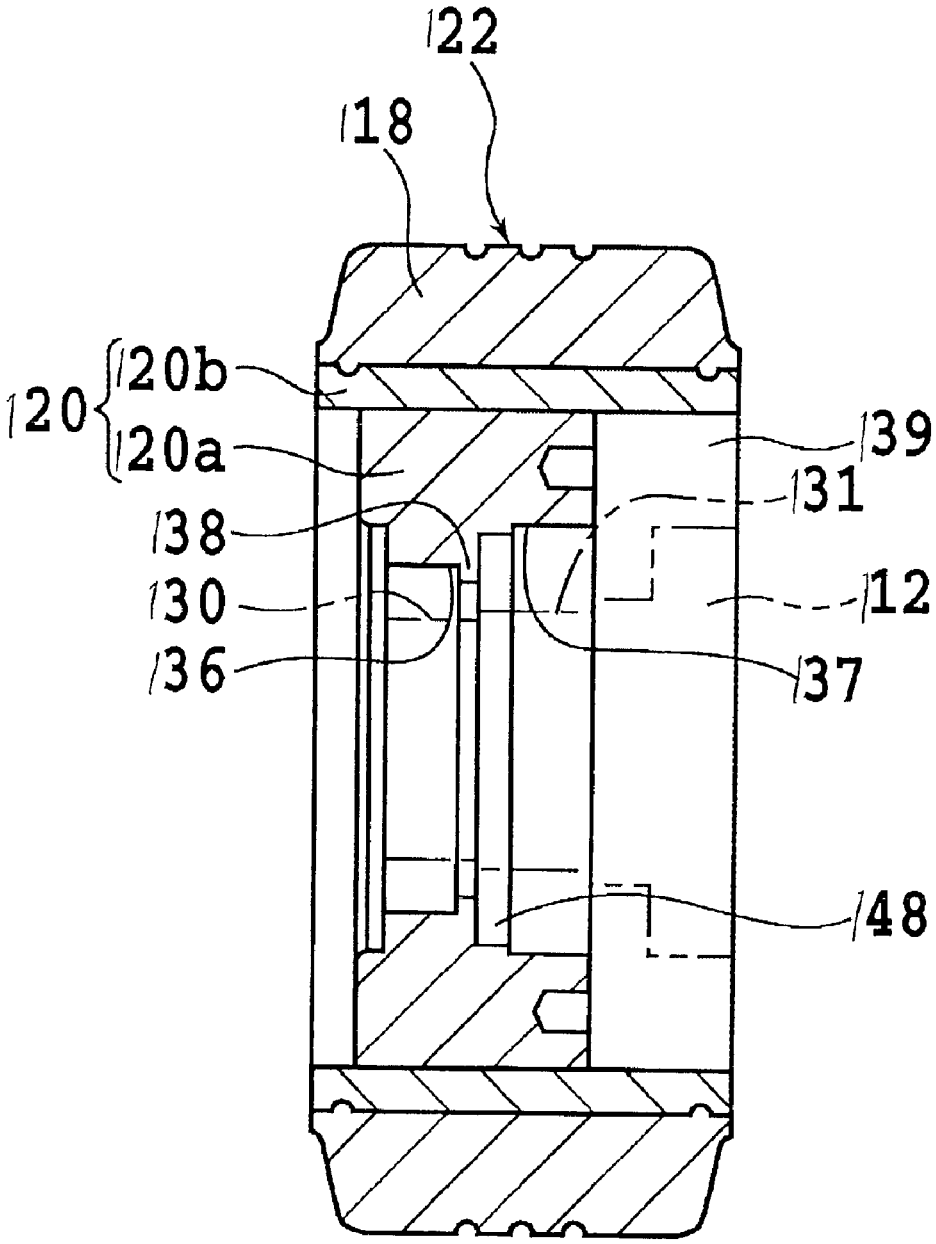
FIG. 11 is an enlarged sectional view of a load wheel shown in FIG. 9, with a load wheel shaft being illustrated in imaginary lines.

As shown in FIG. 11, the load wheel shaft 112 has a first bearing mounting portion 130 provided on a distal end and a second bearing mounting portion 131 provided on a base end thereof. The second bearing mounting portion 131 has a diameter larger than that of the first bearing mounting portion 130. The load wheel 122 has a tire 118 provided on an outer circumference of the wheel and a hub 120 fitted on the first bearing 134 and the second bearing 116 on an inner circumference of the hub. An outer circumferential surface of the tire 118 is brought into contact with the ground.

As shown in FIG. 9, the first bearing 134 has an inner race 132 which is fitted on the first bearing mounting portion 130 of the load wheel shaft 112 and an outer race 133 which is spaced apart from the inner race 132 radially outwardly, and balls or rollers are disposed between the inner race 132 and the outer race 133. The second bearing 116 has an inner race 114 which is fitted on the second bearing mounting portion 131 of the axle load wheel shaft and an outer race 115 which is spaced apart from the inner race 114 radially outwardly, and balls or rollers are disposed between the inner race 114 and the outer race 115. Furthermore, a rotation sensor 108 is provided on an axially outer side of the second bearing 116.

As shown in FIG. 11, the hub 120 of the load wheel 122 includes a hub main body 120*a* and a base band 120*b*, the load wheel 122 is generally formed into a cylindrical shape. The hub main body 120*a* is press fitted in an inner circumferential surface of the base band 120*b* in a condition in which the tire 118 is mounted on an outer circumferential surface of the base band 120*b*, whereby the load wheel 122 is formed. The hub main body 120*a* has on an inner circumference thereof a first bearing installing portion 136 into which the outer race 133 of the first bearing 134 is fitted, a second bearing installing portion 137 into which the outer race 115 of the second bearing 116 is fitted, and a shoulder portion 138. The length of the hub main body 120*a* along with the axial direction of the load wheel shaft 112 is made shorter than the axial length of the base band 120*b*, so that a step is formed between the hub main body 120*a* and the base band 120*b* on a base end side of the load wheel shaft 112 when the hub main body 120*a* is press fitted in the base band 120*b*. A space generated by this step serves a containing portion 139, Providing the step corresponds to providing the containing portion 139 in a recessed fashion in such a manner as to direct the base end portion of the load wheel shaft 112.

Figure 12:
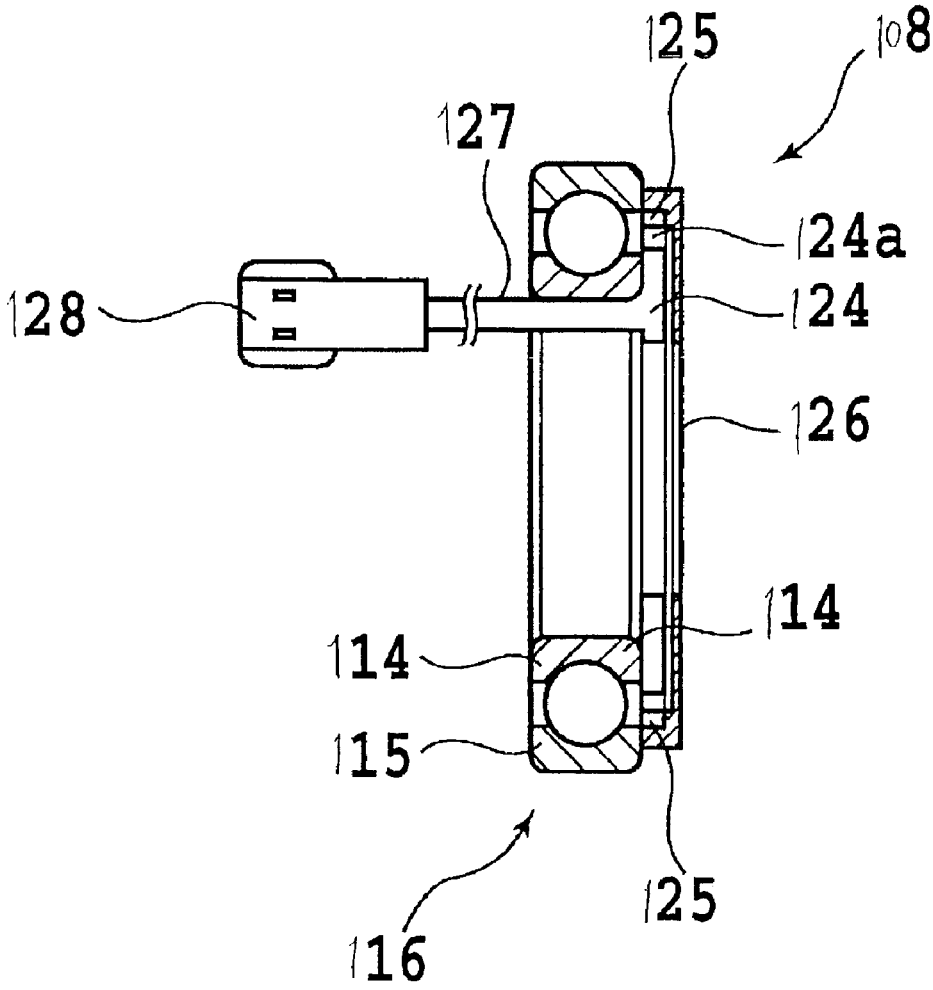
FIG. 12 is an enlarged sectional view of a rotation sensor shown in FIG. 9.
Figure 13:
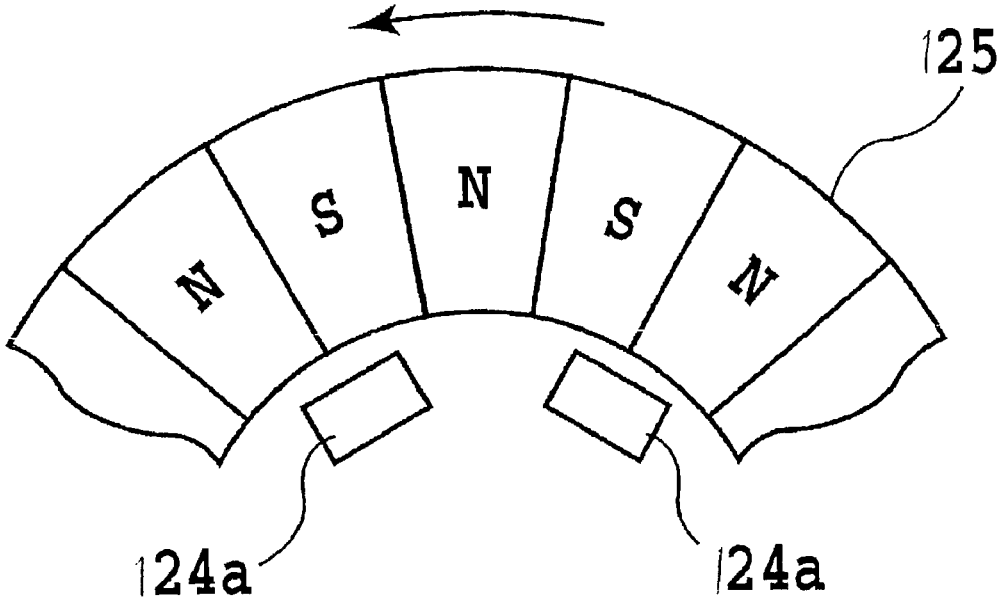
FIG. 13 is an explanatory view showing a main portion of the rotation sensor.

Referring to FIG. 12 which shows a cross section of the rotation sensor 108, the rotation sensor 108 has a sensor (detecting element) 124 mounted on the inner race 114 of the second bearing 116 and a magnet 125 functioning as a detected body mounted on the outer race 115 of the second bearing 116. The detecting element used for the sensor 124 in this embodiment is a hall element 124*a*. The hall element 124*a* is confronted with the magnet 125 via a thin gap. Namely, the hall element 124*a* is disposed in such a manner as to be space apart a predetermined distance from the magnet 125 radially inwardly. On the other hand, as shown in FIG. 13, the magnet 125 is magnetized such that N poles and S poles are disposed alternately in a circumferential direction at predetermined intervals, and magnetized portions confront the hall elements 124*a*. A socket 126 is provided to cover the sensor 124 and the magnet 125, and a connector 128 is provided at an end portion of a signal cable 127 connected to the sensor 124.

The rotation sensor 108 thus structured functions as follows. When the reach type forklift truck 101 moves (runs), a force is applied to the tire 118 by the ground whish is in contact with the tire 118 and which rotates the tire 118, and in conjunction with the rotation of the tire 118 by the force so applied the hub 120 rotates together with the outer race 115 of the second bearing 116 and the magnet 125 on the outer race 115. In constrast, the inner race 114 is fitted on the load wheel shaft 112 and maintained in a condition in which the inner race 114 does not rotate, and the sensor 124 provided on the inner race 114 detects the rotation of the magnet 125 which rotates together with the outer race 115. A detection signal resulting from the detection of the rotation of the magnet 125 is then transmitted to the connector 128 via the signal cable 127 and is then processed by a controller (not shown) connected to the connector 128 as the number of rotations of the load wheel 122.

As shown in FIG. 13, when the load wheel 122 rotates in a direction indicated by an arrow the outer race 115 of the second bearing 116 rotates together with the magnet 125 in the direction indicated by the arrow. When there is caused a variation in magnetic field by the rotation of the magnet 125 a hall voltage is generated in the hall elements 124*a* by virtue of hall effects. However, since the N poles and S poles are disposed alternately on the magnet 125, the hall voltage varies periodically. These periodic variations in the hall voltage are converted into pulse signals in an electronic circuit incorporated in the sensor 124, and the number of rotations of the magnet 125, that is, the number of rotations of the load wheel 122 is detected by counting the number of pluses.

In addition, as shown in FIG. 13, when the plurality of hall elements 124*a* (for example, two hall elements) are disposed in the circumferential direction at a certain interval, there is generated a deviation in time between pulse signals generated from the respective hall elements 124*a*. The rotating direction can be detected by the deviation in time. Namely, the magnet 125 is rotating in a direction from the hall element 124*a* which has outputted a pulse signal before to the hall element 124*a* which is outputting a pulse signal next is detected, whereby the rotating direction of the load wheel 122 is detected.

In this embodiment, as shown in FIG. 9, an electromagnetic brake 140 is provided in such a manner as to be contained in the containing portion 139 in the hub 120 in the vicinity of the base end portion of the load wheel shaft 112. The electromagnetic brake 140 has a coil 142 fixed to the load wheel shaft 112, an armature 143 mounted on the hub 120 in such a manner as to move in the axial direction of the hub 120 but not to rotate with the hub and positioned so as to confront with the coil 142, and a friction pad 144 provided on a armature-facing-side of the coil 142. In this embodiment, the armature 143 is pinned to the hub 120 at a plurality of positions and is allowed to move in the axial direction within a range that is shorter than the length of the pins. In addition, a power supply cable 145 is connected to the coil 142, and power is supplied from a power source contained in the apparatus containing box 106 on the truck main body 103 to the coil 142 via this power supply cable 145.

The electromagnetic brake 140 functions as follows. When the load wheel 122 rotates with the coil 142 not being energized, the armature 143 rotates together with the hub 120 about the load wheel shaft 112. When the coil 142 is energized, the armature 143 is attracted toward the coil 142 to be brought into close contact with the friction pad 144 provided on the coil 142. The rotation of the armature 143 is stopped by a friction force generated as a close contact occurs between the attracted armature 143 and the friction pad 144, whereby a brake is applied to the load wheel 122.

Next, how to assemble the load wheel 122 and the electromagnetic brake 140 in the thus structured reach type forklift truck will be described.

Firstly, the signal cable 127 extending from the rotation sensor 108 is passed inwardly of the inner race 114 of the second bearing 116 and is then drawn to the outside. In this condition, the signal cable 127 is passed to the interior of the coil 142 of the electromagnetic brake 140. Then, the coil 142 is fixed to the load wheel shaft 112, and the inner race 114 is press fitted in the second bearing mounting portion 131 of the load wheel shaft 112.

Next, the armature 143 of the electromagnetic brake 140 is mounted in the hub 120 of the load wheel 122, and in this condition, the load wheel 122 is forced onto the load wheel shaft 112, so that the coil 142 and the armature 143 are confronted with each other and the outer race 115 of the second bearing 116 is fitted in the second bearing installing portion 137 of the hub 120, whereby the rotation sensor 108 is disposed in a gap 148 between the shoulder portion 138 of the hub 120 and the second bearing installing portion 137. The assembly of the second bearing 116 fitted with the rotation sensor 108 and the electromagnetic brake 140 is completed.

On the other hand, after the completion of the assembly described above, the first bearing 134 is assembled by press fitting the outer race 133 of the first bearing 134 in the first bearing installing portion 136 of the hub 120 and fitting the inner race 132 in the first bearing mounting portion of the load wheel shaft 112. This completes the assembly of the load wheel 122.

Then, a wiring operation for the signal cable 127 drawn out of the rotation sensor 108 and a connecting operation for connecting the connector 128 with the controller are carried out after the completion of the assembly of the load wheel 122. In a case where the electromagnetic brake 140 is provided as with this embodiment, a wiring operation of the power supply cable 145 is also carried out.

As shown in FIG. 9, the signal cable 127 and the power supply cable 145 are guided through a gap 146 between the straddle arm 110 and the load wheel 122. As shown in FIG. 10, a groove 147 is formed in the outer circumferential surface of the load wheel shaft 112 in such a manner as to extend in the axial direction, and the signal cable 127 from the rotation sensor 108 is disposed in the groove 147 to be guided to the gap 146. Then, the signal cable 127 and the power supply cable 145 which are both guided into the gap 146 are wired along a wall surface of the wheel housing 111 toward the truck main body 103. Then, the connector 128 is connected to the controller, and the power supply cable 145 is connected to the power source. As shown in FIG. 10, a cover 151 having a U-shaped cross section may be mounted on seats 150 provided on the wall surface of the wheel housing 111 with bolts 152 so as to cover the signal cable 127 and the power supply cable 145 for protection.

In the embodiment described above, the sensor 124 includes the hall elements 24*a* as detecting elements. Instead of the hall elements 24*a*, elements exhibiting magnetoresistance (a phenomenon in which an electric resistance varies due to variation in an external magnetic field) or elements exhibiting magnetic impedance effects (a phenomenon in which an impedance varies due to variation in an external magnetic field) may be used as the detecting elements. In particular, in a case where the elements exhibiting the magnetic impedance effects are used, since the variation in impedance due to variation in the external magnetic field is more remarkable than the variation in electric resistance due to variation in the external magnetic field, the detection of rotation can be implemented with a higher sensitivity than a case where the other elements are used as the detecting elements. Consequently, even in the event that the truck main body 103 vibrates while running, the rotation of the load wheel 122 can be detected in a stable fashion.

In the above embodiment, while the bearings 116, 134 are constructed such that the outer races 115, 133 rotate relative to the inner races 114, 132 via the balls or rollers, a radial bearing of another type such as a journal bearing may instead be used. In addition, with a small axle load being applied to the load wheel 122, a construction may be adopted in which a single bearing 116 incorporating the rotation sensor 108 is disposed between the load wheel shaft 112 and the hub 120.

Figure 14:
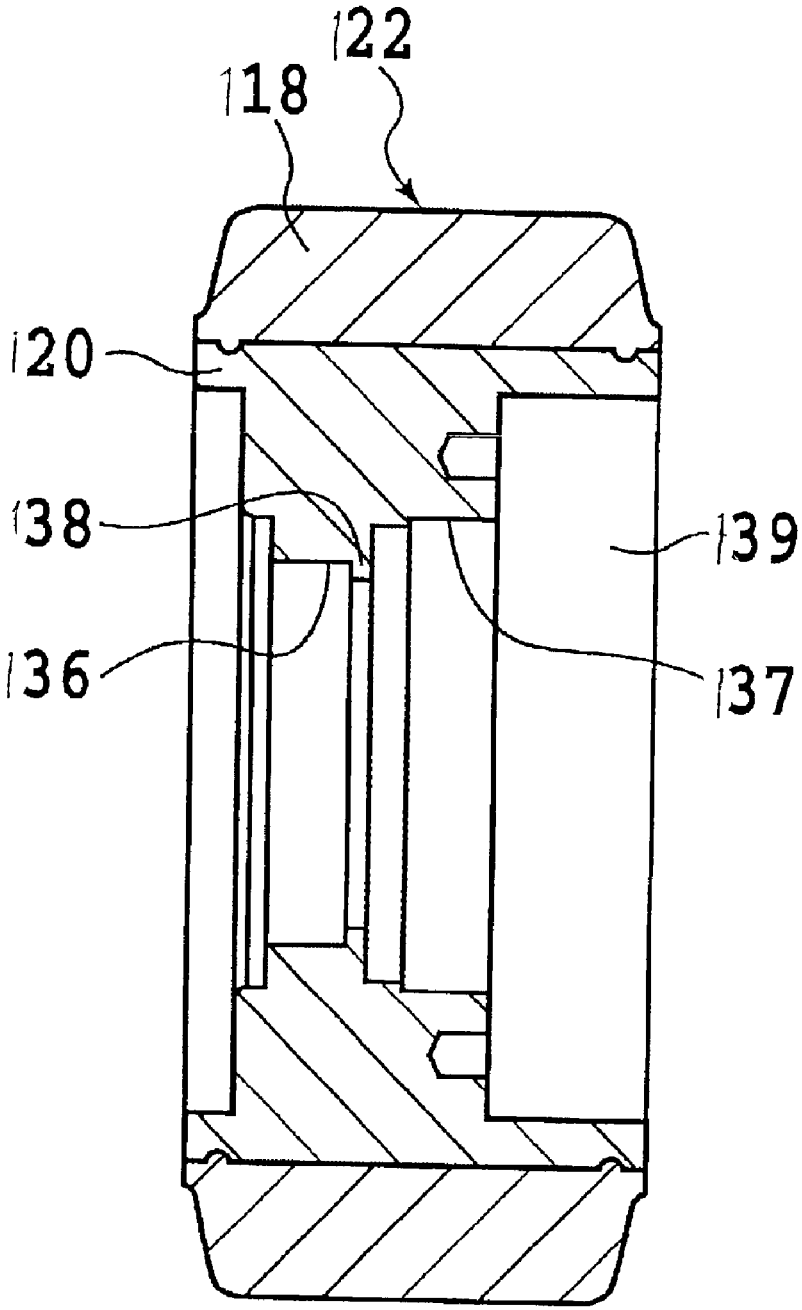
FIG. 14 is an enlarged sectional view showing a load wheel according to a fourth embodiment of the invention.
Figure 15:
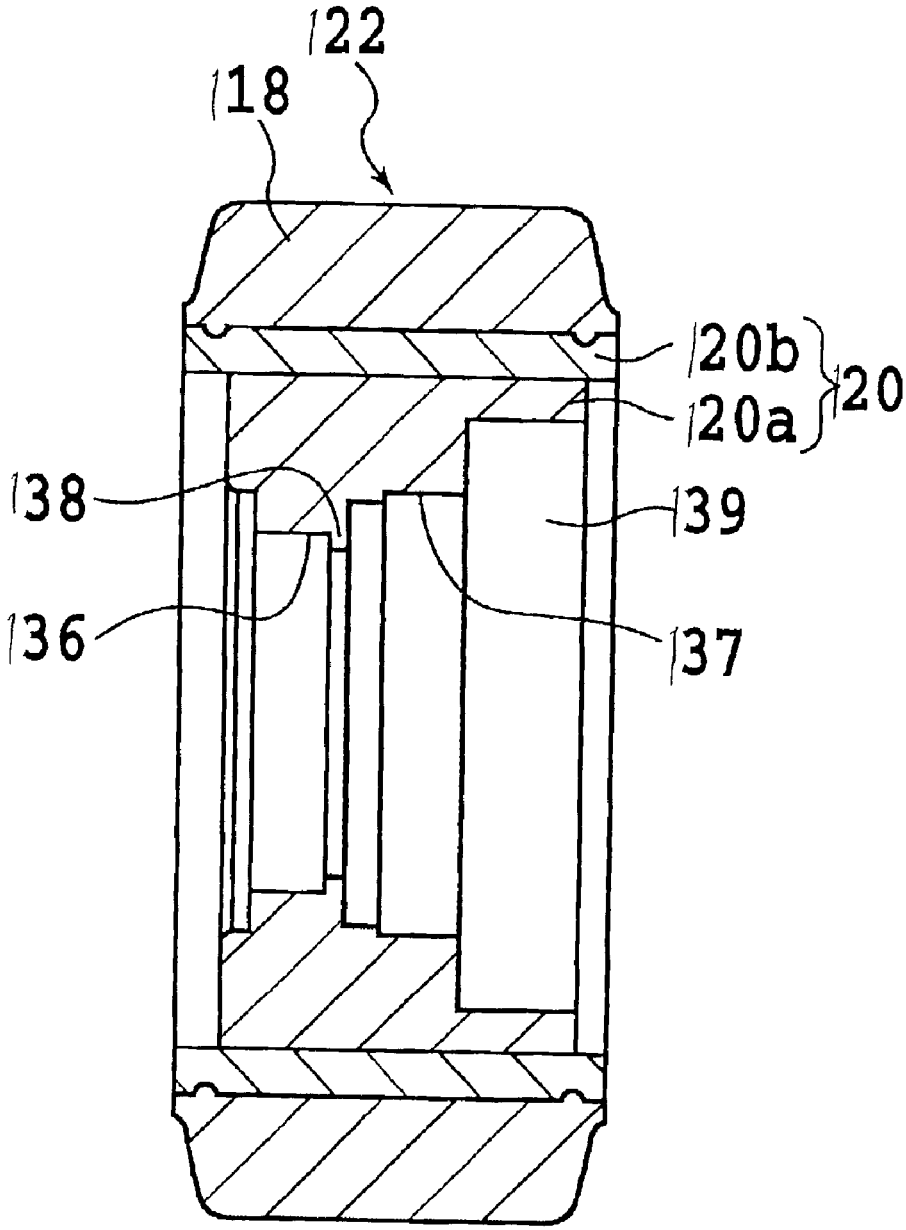
FIG. 15 is an enlarged sectional view showing a load wheel according to a fifth embodiment of the invention.

In addition, in providing the containing portion 139 in the recessed fashion in such a manner that the containing portion 139 directs the base end portion of the load wheel shaft 112, the hub 120 may be formed as shown in FIGS. 14 and 15 which show cross sections thereof. In an embodiment shown in FIG. 14, a hub 120 takes the form shown in FIG. 10 in which the hub main body 120*a* and the base band 120*b* are formed as the integral part, and a step formed in the hub 120 itself constitutes a containing portion 139. In an embodiment shown in FIG. 15, a hub 120 includes a hub main body 120*a*, a base band 120*b*, and a step formed in the hub main body 120*a*. The step constitutes a containing portion 139.

Furthermore, in the embodiment that has been described heretofore, the electromagnetic brake 140 is disposed within the containing portion 139 in the hub 120. Instead, a mechanical brake or a hydraulic brake may be installed in the containing portion 139. In addition to the electromagnetic brake 140, a measuring apparatus for measuring an axle load applied to the load wheel shaft 112 or a motor for driving the load wheel 122 may be contained in the containing portion 139.

Note that the invention is not limited to the embodiments described heretofore and may be modified in various ways without departing from the spirit and scope of the invention.

As has been described heretofore, according to a reach type forklift truck as set forth in the first aspect of the invention, a rotation sensor for detecting the rotation of the load wheel is interposed between the load wheels and the load wheel shaft for supporting the load wheels, and a signal line to be connected to the rotation sensor is inserted into a guide groove formed in the load wheel shaft. By this structure, the number of parts necessary for installation of the rotation sensor can be reduced, the structure of the present forklift truck can be simplified greatly, and the rotation sensor can be installed free from the size of a clearance between reach arms and travelling road surface.

Also, according to a reach type forklift truck as set forth in the second aspect of the invention, provision of the rotation sensor on the outside of a brake device not only can prevent the rotation sensor from being influenced by the heat that is generated in the brake device, but also can increase the cooling effect of the outside air on the rotation sensor, thereby the deterioration of detect accuracy of the rotation sensor is prevented.

Further, according to a reach type forklift truck as set forth in the fourth aspects of the invention, there is a detecting element on the load wheel shaft side that does not rotate, and there is a detected element on the load wheel side that rotates around the load wheel shaft. By this structure, the signal line, which lies in between the load wheel and the load wheel shaft, can be disposed on the load wheel shaft without twisting.

Further, according to a reach type forklift truck as set forth in the third and fifth aspects of the invention, the rotation sensor is mounted on the bearing, or a rotary encoder is used as the rotation sensor. Therefore, the installation of the rotation sensor between the load wheels and load wheel shaft can be facilitated.

According to a reach type forklift truck as set forth in the sixth aspect of the invention, since the rotation sensor is provided on the bearing, there is no risk that an impact is directly applied to the rotation sensor from the outside, whereby the deterioration in sensor accuracy can be prevented. Consequently, the rotation sensor of the invention can be used to detect accurately the running speed of the reach type forklift truck, as well as the slippage of the wheel thereof, thereby making it possible to increase the safety of the reach type forklift truck. In addition, since the rotation sensor can be handled together with the bearing, less man hours are needed to mount and/or dismount the rotation detector, and no adjustment for the positional relationship between the detected element and the detecting is required to be implemented every time the rotation detector is mounted.

According to the sebenth aspect of the invention, since the rotation sensor is constituted by the magnet and the magnetic sensor, the rotation can be detected in an non-contact condition, and wear of the respective portions of the rotation detector that would occur with a detection through contact is not generated. Consequently, not only can the deterioration in sensor accuracy due to the ware of the respective portions of the rotation sensor be prevented but also no maintenance of the rotation sensor is required. As a result, the safety of the reach type forklift truck can be increased, and additionally the increase in production costs can be suppressed as well.

According to the eighth aspect of the invention, since the rotation sensor is provided on the bearing which is disposed at the position closest to the base end portion of the load wheel shaft, in mounting the wheel in which the bearing incorporating the rotation sensor is fitted therein in advance, the mounting operation can be implemented easily. In addition, since the rotation sensor is provided on the side of the bearing which is opposite to the base end portion of the load wheel shaft, the rotation sensor is disposed within the wheel to be protected thereby, and the failure of the rotation sensor can thus be prevented, allowing the rotation sensor to detect the rotation of the wheel with good accuracy.

According to the ninth aspect of the invention, since the hub includes the containing portion which is provided in the recessed fashion in such a manner as to direct the base end portion of the load wheel shaft, any desired apparatus can be contained in this containing portion. In addition, since the containing portion is recessed in such a manner as to direct the base end portion of the load wheel shaft, apparatuses provided on the base end portion of the load wheel shaft can be contained in this containing portion. Consequently, the spaces in the vicinity of the base end portions of the load wheel shaft of the reach type forklift truck can be used effectively, thereby making it possible to attempt to make the reach type forklift truck compact.

According to the tenth aspect of the invention, since the brake system is disposed in the containing portion in the hub, the brake system can be protected by the hub.

Consequently, a failure of the brake system due to the direct application of an impact from the outside can be prevented, thereby making it possible to increase the safety of the reach type forklift truck.

What is claimed is:

1. A reach type forklift truck, comprising:

a truck main body;

a pair of straddle arms provided on and extended forwardly from the truck main body;

a mast movably mounted on the straddle arms so as to move back and forth, the mast having rollers;

a load wheel shaft fixed to the front portion of the straddle arm, the load wheel shaft having a guide groove;

a load wheel rotatably disposed on the load wheel shaft;

a rotation sensor for detecting the rotation of the load wheel;

a signal line for transmitting a detected signal of the rotation sensor to the truck main body side; and a pair of reach rails in which the rollers are rollably fitted, the reach rails being provided on the mutually opposed sides of the straddle arms, wherein the rotation sensor is disposed between the load wheel and the load wheel shaft, the guide groove extends from the neighboring portion of the rotation sensor to the reach rail side, the signal line is inserted in the guide groove.

2. The reach type forklift truck according to claim 1, further comprising a brake device, the brake device being disposed so as to surround a base end portion of the load wheel shaft, wherein the rotation sensor is disposed outwardly from the brake device.

3. The reach type forklift truck according to claim 1 or 2, further comprising a bearing having an inner race and an outer race, the bearing being disposed at between the load wheel and the load wheel shaft so as to support the load wheel rotatably with respect to the load wheel shaft, wherein the rotation sensor is disposed on the bearing and detects a relative rotation of the inner and outer races.

4. The reach type forklift truck according to claim 3, wherein the inner race is fixed on the load wheel shaft, the outer race is fixed on the load wheel thereby the outer race is rotatable with respect to the inner race, the rotation sensor comprises a detected element disposed on the outer race and is rotatable together with the load wheel, and a detecting element is disposed on the inner race to detect the rotation of the detected element.

5. The reach type forklift truck according to claim 1 or 2, wherein the rotation sensor comprises a rotary encoder having a body and a rotary shaft, the body is mounted on the center of the load wheel shaft, and the rotary shaft is integrally connected to the load wheel.

6. A reach type forklift truck, comprising:

a truck main body;

a straddle arm provided on and extended forwardly from the truck main body;

a wheel shaft fixed to the straddle arm;

a bearing having an inner race engaged on the wheel shaft and an outer race rotatable with respect to the inner race;

a wheel rotatably disposed on the wheel shaft via the bearing; and a rotation sensor for detecting a rotation of the wheel, wherein the rotation sensor comprises a detected element disposed on the outer race and rotates together with the wheel, and a detecting element disposed on the inner race for detecting a rotation of the detected element.

7. The reach type fork lift according to claim 6, wherein the detected element is a magnet which is magnetized, and the detecting element is a magnetic sensor for detecting a variation in a magnetic field caused by the rotation of the magnet.

8. The reach type fork lift according to claim 6 or 7, wherein the wheel is rotatably disposed on the load wheel via a plurality of bearings, and the rotation sensor is provided outwardly from a bearing that is disposed at a position closest to a base end portion of the wheel shaft.

9. The reach type fork lift according to claim 6 or 7, wherein the wheel is constituted by a hub formed into a cylindrical shape and a tire provided on an outer circumference of the hub, and the hub comprises a bearing installing portion for fittingly installing the outer race, and a containing portion directed toward the base end portion of the wheel shaft in a recessed fashion.

10. The reach type fork lift according to claim 9, further comprising a brake device for braking the wheel, the brake device being disposed in the containing portion.

* * * * *